US011328660B2

(12) United States Patent
Gao et al.

(10) Patent No.: US 11,328,660 B2
(45) Date of Patent: May 10, 2022

(54) DISPLAY DEVICE AND DRIVING METHOD THEREOF

(71) Applicant: Shanghai Tianma AM-OLED Co.,Ltd., Shanghai (CN)

(72) Inventors: Yana Gao, Shanghai (CN); Yuantao Wu, Shanghai (CN); Xingyao Zhou, Shanghai (CN); Mengmeng Zhang, Shanghai (CN); Yue Li, Shanghai (CN); Ranran Zeng, Shanghai (CN)

(73) Assignee: Shanghai Tianma AM-OLED Co., Ltd., Shanghai (CN)

( * ) Notice: Subject to any disclaimer, the term of this patent is extended or adjusted under 35 U.S.C. 154(b) by 0 days.

(21) Appl. No.: 17/106,546

(22) Filed: Nov. 30, 2020

(65) Prior Publication Data

US 2022/0101787 A1 Mar. 31, 2022

(30) Foreign Application Priority Data

Sep. 29, 2020 (CN) ..... 202011057344.8

(51) Int. Cl.
*G09G 3/3225* (2016.01)
*G09G 3/20* (2006.01)

(52) U.S. Cl.
CPC ..... *G09G 3/3225* (2013.01); *G09G 3/2074* (2013.01); *G09G 2310/0202* (2013.01); *G09G 2310/0297* (2013.01); *G09G 2310/08* (2013.01); *G09G 2330/021* (2013.01)

(58) Field of Classification Search
CPC ..... G09G 3/3275–3291; G09G 3/3688–3696
See application file for complete search history.

(56) References Cited

U.S. PATENT DOCUMENTS

2013/0127806 A1* 5/2013 Wu ..... G09G 3/3688 345/211
2017/0061872 A1* 3/2017 Zhou ..... G09G 3/3266
2017/0358261 A1* 12/2017 Zhou ..... G09G 3/3258

FOREIGN PATENT DOCUMENTS

CN 106531767 A 3/2017
CN 110880286 A 3/2020

* cited by examiner

*Primary Examiner* — Hang Lin
(74) *Attorney, Agent, or Firm* — Anova Law Group, PLLC

(57) ABSTRACT

Display devices and methods for driving display devices are provided. The method may include, in a first stage of the data writing phase, always turning on m1 first switch units of each multiplexer under a control of m1 corresponding clock signal lines, and sequentially turning on m2 second switch units for a preset time in a preset order; in a second stage of the data writing phase, keeping the m1 first switch units always on, turning off the m2 second switch units, and writing corresponding data voltage signals to the row of sub-pixels to cause the row of sub-pixels to display; and in the display maintaining phase, displaying same as in the second stage of the data writing phase. At least one first switch unit is always turned on under the control of a corresponding clock signal line when at least two continuously scanned rows of sub-pixels are displaying.

16 Claims, 9 Drawing Sheets

DISPLAY DEVICE AND DRIVING METHOD THEREOF

CROSS-REFERENCE TO RELATED APPLICATION

This application claims the priority of Chinese Patent Application No. 202011057344.8, filed on Sep. 29, 2020, the content of which is incorporated by reference in its entirety.

TECHNICAL FIELD

The present disclosure generally relates to the field of display technology and, more particularly, relates to a display device and a method for driving a display device.

BACKGROUND

With the development of science and technology, more and more electronic devices with display functions are widely used in people's work and life, such as handheld devices including mobile phones and tablet computers, and wearable devices including smart watches and smart bracelets.

Due to the small size of wearable devices, such as smart watches and smart bracelets, their battery capacities are difficult to increase due to the volume limitations. Therefore, how to reduce the power consumption of the wearable devices during the display stage is an urgent problem to be solved. The disclosed display devices and methods for driving the display devices are directed to solve one or more problems set forth above and other problems in the art.

SUMMARY

One aspect of the present disclosure provides a method for driving a display device. The method may include providing the display device. The display device may include a plurality of sub-pixels arranged as an array. Each row of sub-pixels are connected by a scan line; each column of sub-pixels are connected by a data line; the display device also includes a plurality of multiplexers; each multiplexer includes a number m switch units; the number m switch units include m1 first switch units and m2 second switch units; m, m1, and m2 are all positive integers; output terminals of different switch units of a same multiplexer are connected to different data lines; input terminals of all switch units of the same multiplexer are connected to a same data voltage input terminal; control terminals of different switch units of the same multiplexer are connected to different clock signal lines; and a row display time period of a row of sub-pixels of one frame of display image of the display device includes a data writing phase and a display maintaining phase. The method may also include, in a first stage of the data writing phase, always turning on the m1 first switch units of each multiplexer under a control of the m1 corresponding clock signal lines, and sequentially turning on the m2 second switch units for a preset time in a preset order under a control of the m2 corresponding clock signal lines. Further, the method may include, in a second stage of the data writing phase, keeping the m1 first switch units being always turned on under a control of the corresponding m1 clock signal lines, turning off the m2 second switch units under a control of the corresponding m2 clock signal lines, and writing corresponding data voltage signals to the row of sub-pixels to cause the row of sub-pixels to display under a control of corresponding scan lines. Further, the method includes in the display maintaining phase, displaying same as in the second stage of the data writing phase. At least one of the plurality of first switch units is always turned on under a control of a corresponding clock signal line when at least two continuously scanned rows of sub-pixels are displaying.

Another aspect of the present disclosure provides a display device. The display device may include a display panel and a driving chip. The display panel may include a plurality of sub-pixels arranged as an array; each row of sub-pixels are connected by a scan line; each column of sub-pixels are connected by a data line; the display panel also includes a plurality of multiplexers; each multiplexer includes at least two switch units; output terminals of different switch units of a same multiplexer are connected to different data lines; input terminals of all switch units of the same multiplexer are connected to a same data voltage input terminal; and control terminals of different switch units of the same multiplexer are connected to different clock control signal lines. The driving chip is used to execute the driving method of the display device.

Other aspects of the present disclosure can be understood by those skilled in the art in light of the description, the claims, and the drawings of the present disclosure.

BRIEF DESCRIPTION OF THE DRAWINGS

The following drawings are merely examples for illustrative purposes according to various disclosed embodiments and are not intended to limit the scope of the present disclosure.

DETAILED DESCRIPTION

The present disclosure will be further described in detail below in conjunction with the drawings and embodiments. It can be understood that the specific embodiments described here are only used to explain the present disclosure, but not to limit the present disclosure. In addition, it should be noted that, for ease of description, the drawings only show part of the structure related to the present disclosure, but not all of the structure.

The features and exemplary embodiments of each aspect of the disclosure will be described in detail below. To make the objectives, technical solutions, and advantages of the disclosure more clear, the disclosure will be further described in detail below in conjunction with the drawings and specific embodiments. It should be understood that the specific embodiments described here are only configured to explain the present disclosure, and not configured to limit the present disclosure. For those skilled in the art, this disclosure can be implemented without some of these specific details. The following description of the embodiments is only to provide a better understanding of the present disclosure by showing examples of the present disclosure.

It should be noted that in this disclosure, relational terms such as first and second are only used to distinguish one entity or operation from another entity or operation, and do not necessarily require or imply one of these entities or operations to have any such actual relationship or order between.

It should be understood that when describing the structure of a component, when a layer or an area is referred to as being "on" or "above" another layer or another area, it can mean that it is directly on the other layer or area, or there are other layers or regions between it and another layer or another region. Further, if the component is turned over, the layer or area will be "below" or "below" another layer or area.

With the development of display technologies, the types of electronic products with screens have become more and more abundant. For example, for mobile phones, people have higher requirements for the fluency of the mobile phone display screen. Thus, the refresh rate has been developed from 60 Hz to 90 Hz, 120 Hz. For smart watches, smart bracelets and other wearable devices, the display content is generally relatively simple, such as time, exercise steps, heart rate, etc., and people have the needs of long battery life. Thus, the refresh rate are reduced (for example, 30 Hz, or 15 Hz) to save power consumption.

Figure 1:
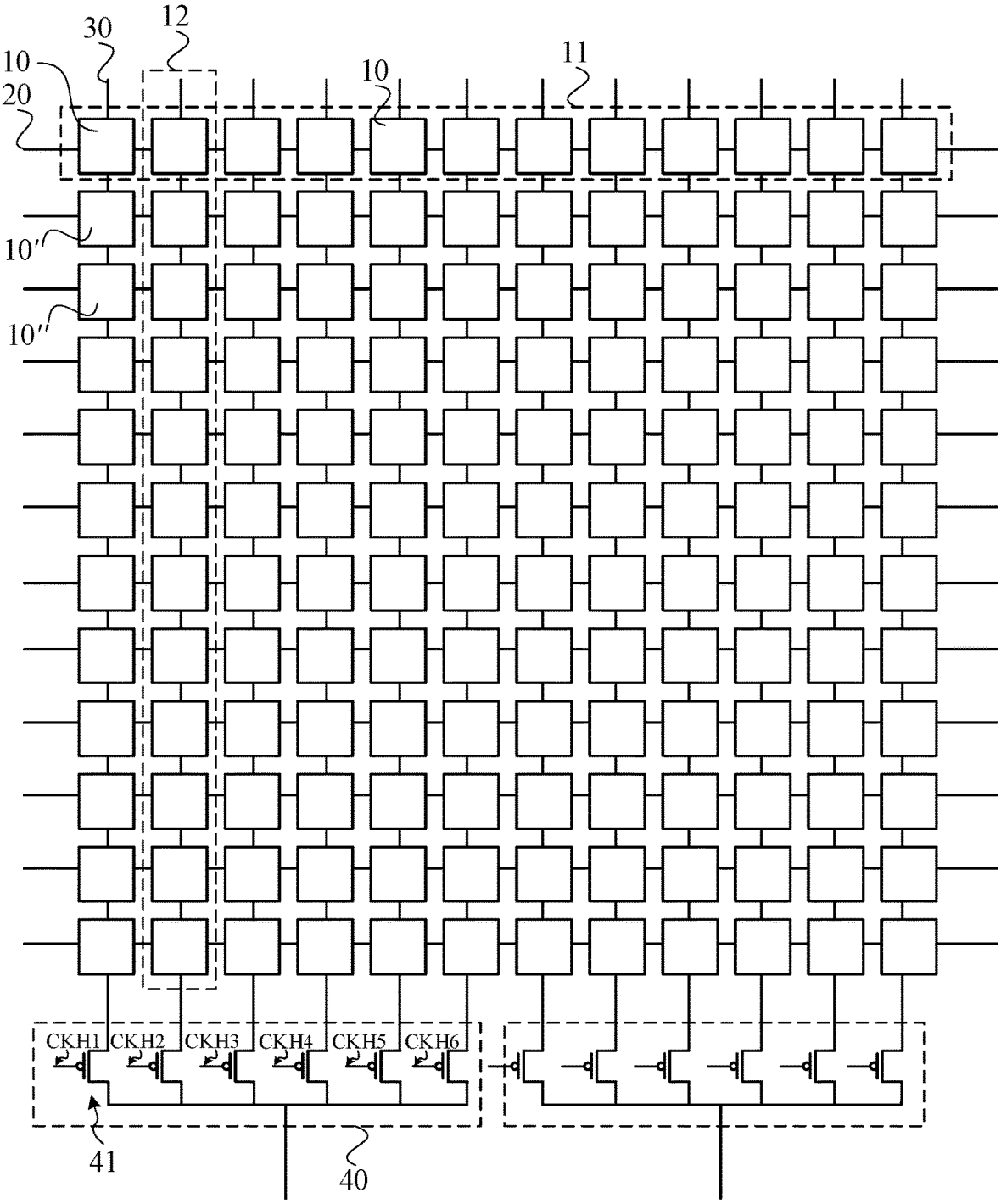
FIG. 1 illustrates a display device.

FIG. 1 shows a schematic structural diagram of a display device. The display device may be an organic light-emitting diode (OLED) display device. As shown in FIG. 1, the display device includes a plurality of sub-pixels 10 arranged in an array. Each row 11 of sub-pixels 10 are connected by a scan line 20, and each column 12 of sub-pixels 10 are connected by a data line 30. The display device also includes a plurality of multiplexers 40 (two multiplexers are illustrated in FIG. 1 as an example). A multiplexer 40 includes a plurality of switch units 41 (six switch units 41 are illustrated in FIG. 1 as an example). The output terminals of different switch units 41 in the same multiplexer 40 are connected to different data lines 30. The input terminals of each switch unit 41 of the same multiplexer 40 are connected to the same data voltage input terminal. The control terminals of the different switch units 41 of the same multiplexer 40 are connected to different clock control signal lines CKH1 to CKH6. Taking the switch unit 41 is a P-type transistor as an example, the switch unit 41 is turned on at a low level and turned off at a high level.

Figure 2:
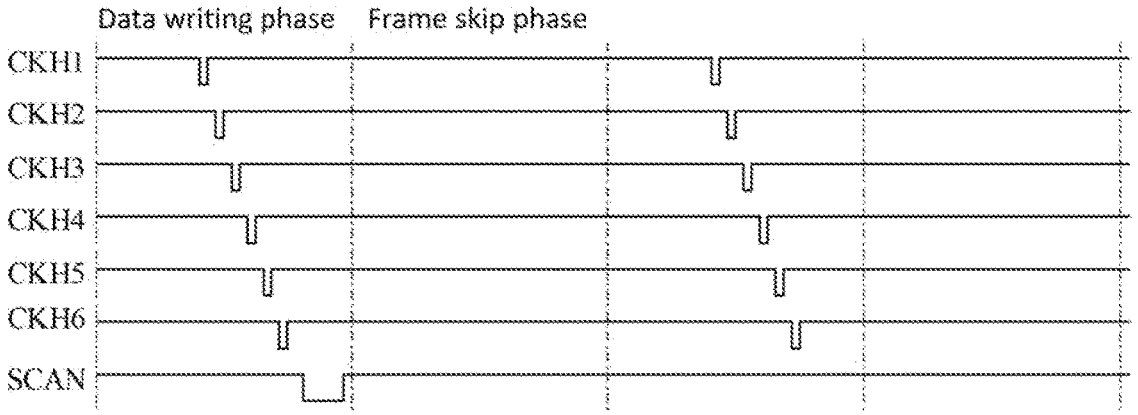
FIG. 2 illustrates a time sequence of a driving method.

FIG. 2 shows a time sequence of a driving method of a display device. As shown in FIG. 2, taking reducing the 60 Hz refresh rate to 30 Hz refresh rate as an example, the display stages of the display device includes a data writing stage and an Frame Skip stage. In the data writing stage, the clock control signal lines CKH1-CKH6 corresponding to each switch unit sequentially change from the high level to the low level such that the data voltage input terminals and the corresponding data lines may be turned on, and the data voltage input terminals write the data voltage to the corresponding column of the data lines. When all the data voltages of a row of sub-pixels are written, the scan signals SCAN corresponding to such a row of sub-pixels causes the data voltages to be written into the corresponding sub-pixels, and then repeat the above process to scan the rows one-by-one to realize the display of a frame of picture of the entire display device. FIG. 2 only shows the control time sequence of one multiplexer unit in one row of sub-pixels in each frame of display picture. No data voltage signal is written in the Frame Skip stage to realize a low frequency display. However, because the major power consumption of the driving chip is the voltage jumps of the data voltage signal and the clock control signal, such a driving method still has the problem of high power consumption.

The present disclosure provides a display device and a method for driving the display device. The display device may include a plurality of sub-pixels arranged as an array. Each row of sub-pixels may be connected by a scan line, and each column of sub-pixels may be connected by a data line. The display device may also include a plurality of multiplexers. Each multiplexer may include m switch units. The m switch units may include m1 first switch units and m2 second switch units. Wherein m, m1 and m2 may all be positive integers. The output terminals of different switch units of a same multiplexer may be connected to different data lines. The input terminals of all switch units of the same multiplexer may be connected to a same data voltage input terminal. The control terminals of different switch units of the same multiplexer may be connected with different clock control signal lines. The row display time period of a row of sub-pixels of a frame of display image in the display device may include a data writing phase and a display maintaining phase.

Figure 3:
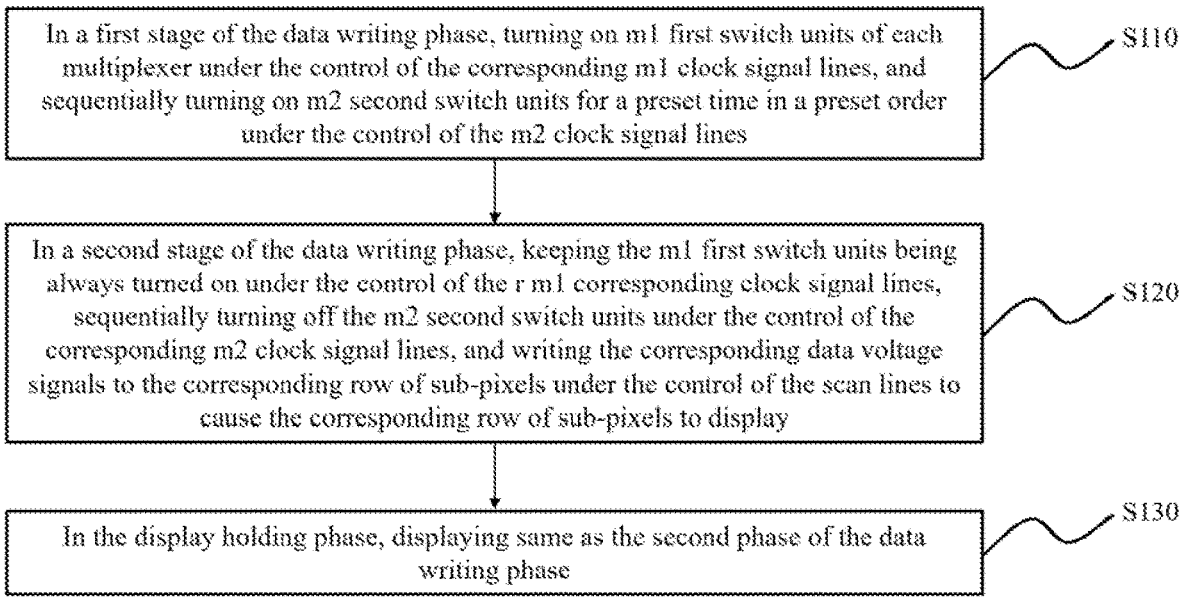
FIG. 3 illustrates a flow chart of an exemplary driving method of a display device consistent with various disclosed embodiments of the present disclosure.

FIG. 3 is a flowchart of an exemplary driving method of a display device consistent with various disclosed embodiments of the present disclosure. As shown in FIG. 3, the driving method may include:

Step S110: in a first stage of the data writing phase, turning on m1 first switch units of each multiplexer under the control of the corresponding m1 clock signal lines, and sequentially turning on m2 second switch units for a preset time in a preset order under a control of the m2 clock signal lines;

Step S120: in a second stage of the data writing phase, keeping the m1 first switch units being always turned on under a control of the m1 corresponding clock signal lines, turning off the m2 second switch units under a control of the corresponding m2 clock signal lines, and writing the corresponding data voltage signals to the corresponding row of sub-pixels under a control of the scan lines to cause the corresponding row of sub-pixels to display; and Step S130: in the display maintaining phase, displaying same as in the second stage of the data writing phase.

At least one first switch unit may always be turned on under the control of the corresponding clock signal line when at least two rows of continuously scanned sub-pixels are displaying.

In the driving method of the display device provided by the present disclosure, in the first stage of the data writing phase, the m1 first switch units of each multiplexer may always be turned on under the control of the corresponding m1 clock signal lines, the m2 second switch units may be sequentially turned on for a preset time in a preset order under the control of the corresponding m2 clock signal lines. Thus, the number of jumps of the clock signals that control the first switch units to turn on may be reduced, and the power consumption may be reduced. In the second stage of the data writing phase, the m1 first switch units may always be turned on under the control of the corresponding m1 clock signal lines, and the m2 second switch units may be turned off under the control of the corresponding m2 clock signal lines to avoid the jumps of the clock signals that control the first switch units and the second switch units to prevent the increasing of the power consumption. The scan lines may control the corresponding row of sub-pixels to write the corresponding data voltage signals to make the sub-pixels to display. In the display maintaining phase, the configuration may be same as the second stage of the data writing phase, which may reduce the refresh frequency of the display device. At least one first switch unit may always be turned on under the control of the corresponding clock signal line when at least two rows of continuously scanned sub-pixels are displaying. Thus, the power consumption of the display device may be reduced, and the battery life of the display device may be increased.

The above is the core idea of the driving method of the display device provided by the present disclosure. The specific steps of the driving method provided by the present disclosure will be explained below with reference to specific embodiments. The following embodiments are only exemplary embodiments of the present disclosure, but not the limitations of the present disclosure.

Figure 4:
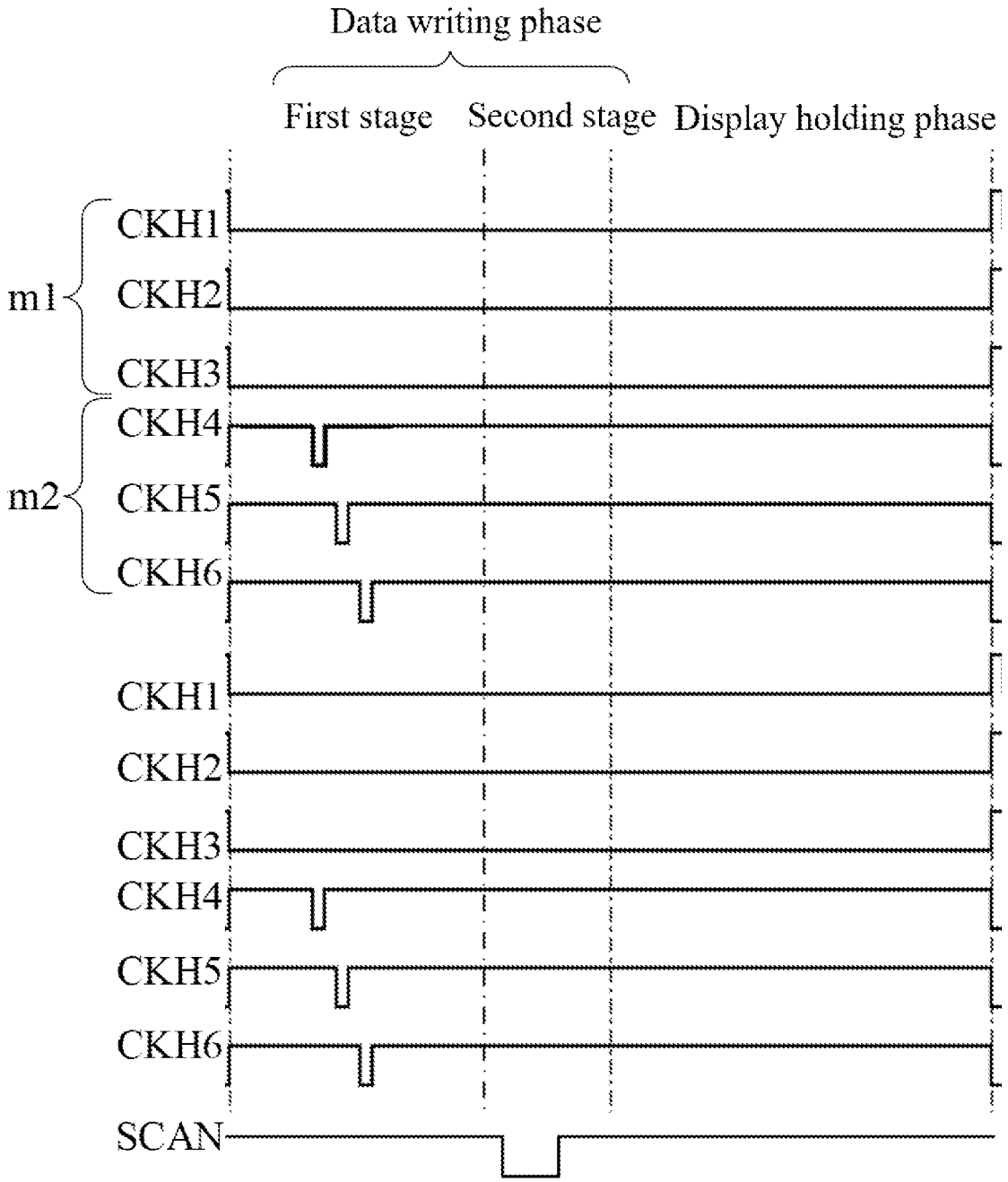
FIG. 4 illustrates a time sequence of an exemplary driving method of a display device when displaying a row of sub-pixels of consistent with various disclosed embodiments of the present disclosure.

FIG. 4 illustrates a time sequence of an exemplary driving method of a display device for displaying one row of sub-pixels consistent with various disclosed embodiments of the present disclosure. For illustrative purposes, FIG. 4 shows two multiplexers, one multiplexer in the display device may include six switch units, the six switch units may include three first switch units and three second switch units (i.e., m=6, m1=3, m2=3), the switch units may all be P-type transistors. In the first stage of the data writing phase, the three (m1) first switch units of each multiplexer may always be turned on under the control of the three corresponding clock signal lines, and their corresponding time sequence signals may always be at low level. The three (m2) second switch units may be sequentially turned on for a preset time in a preset order under the control of the corresponding three clock signal lines, and their corresponding time sequence signals may be turned on when the time sequence signals are low level signals; and the corresponding data voltage signals may be written. In other time periods, the time sequence signals may be at high level, and the corresponding switch units may be turned off. In the second stage of the data writing phase, the three (m1) first switch units may always be turned on under the control of the three corresponding clock signal lines, and the three (m2) second switch units may be turned off under the control of the three corresponding clock signal lines. The scan signal SCAN may drive the scan line to control the corresponding row of sub-pixels to write the corresponding data voltage signal to cause the sub-pixels to display. Then, in the display maintaining phase, the display configuration may be kept same as in the second stage of the data writing phase, which may be the Frame Skip phase. It is understandable that the above sequence indicates that the data writing mode of the sub-pixels in the present disclosure may be the line charging mode. The first stage of the data writing phase may be the phase that the clock signal lines (CKH1-CKH6) in the same multiplexer may all be turned on to write the data signal. In the second stage of the data writing phase, the SCAN signal may be turned on to write the data signal into the corresponding sub-pixels. In the Frame Skip phase, the potential state of the previous moment is maintained; and the sub-pixels may display.

Figure 5:
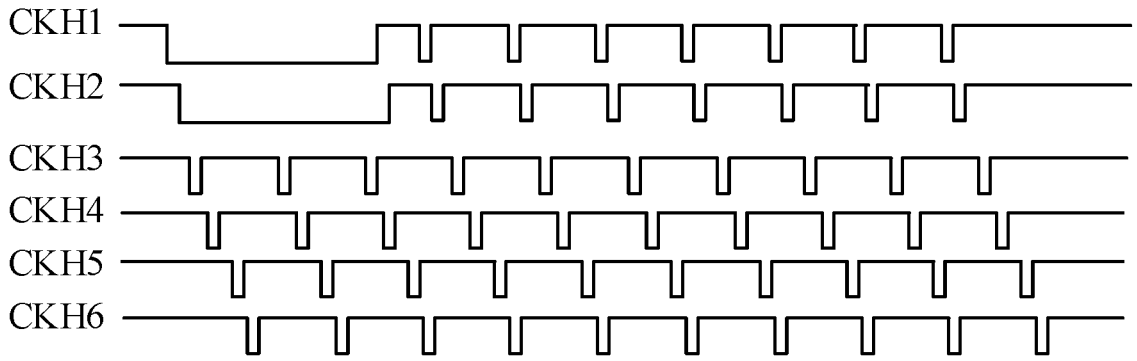
FIG. 5 illustrates a time sequence of an exemplary driving method of a display device when displaying a frame of display image consistent with various disclosed embodiments of the present disclosure.

FIG. 5 illustrates a time sequence of an exemplary driving method of a display device for displaying one frame of display image according to various embodiments of the present disclosure. As shown in FIG. 5, for illustrative purposes, each row of sub-pixels schematically shows only one multiplexer, and the multiplexer may include six switch units, and the six switch units may all be P-type transistors. Further, FIG. 5 only illustrates the control clock signals (i.e., CKH1, CKH2) corresponding to two first switch units may all be at low level when three consecutively scanned rows of sub-pixels are displaying. In particular, two first switch units may always be turned on when three rows of continuously scanned sub-pixels are displaying. Compared with the existing driving method, the number of voltage jumps of the time sequence signals may be reduced, and the power consumption of the display device may be reduced.

It should be noted the configuration that each multiplexer in FIG. 5 may include six switch units and two first switch units that are always turned on when three consecutively scanned rows of sub-pixels are displaying are merely for illustrative purposes. In some embodiments, other numbers of first switch units may also be designed, and it may only need the sub-pixels of at least two consecutively scanned rows are always turned on to reduce the number of jumps of the clock signals. They can also be turned on when all rows of sub-pixels are scanned, the specific configuration may be flexibly selected according to the actual situation. Further, the first switch units and the second switch units described may not be two types of switch units, nor are they fixed. When a certain switch unit is always on during the data writing phase, the switch unit may be referred to as the first switch unit. When a certain switch unit is only turned on for a preset time at the time of data writing, the switch unit may be referred to as the second switch unit. As used herein, the first switch unit and the second switch unit may only be different working states; and the switch units may be not be dived into two fixed categories.

On the basis of the previous embodiment, in one embodiment, the driving method of the display device provided in the present disclosure may further include: writing a same fixed gray-scale voltage to the sub-pixels in at least two consecutively scanned rows of sub-pixels corresponding to the same switch unit.

It can be understood that each switch unit may correspond to a column of sub-pixels, and the display device may writes data voltage in a row-by-row scanning manner during display. Referring to FIG. 1, when the sub-pixel 10 in the first row and the first column is displaying, the switch unit 41 corresponding to the first column of sub-pixels may be turned on, and the data voltage input terminal may provide the data voltage required by the sub-pixel 10 in the first row and the first column. When the sub-pixel 10' in the second row and the first column is displaying, the switch unit 41 corresponding to the first column of sub-pixels may be turned on again, and the data voltage input terminal may provide the data voltage required by the sub-pixel 10' in the second row and the first column. When the sub-pixels 10" in the third row and the first column is displaying, the switch unit 41 corresponding to the first column of sub-pixels may be turned on again, and the data voltage input terminal may provide the data voltage required by the sub-pixels 10" in the third row and first column. The number of the rows of sub-pixels may be equal to the number of times of the switch unit needed to be turned on and the number of times of the data voltage needed to be written. In one embodiment, by setting the sub-pixels in at least two consecutively scanned rows of sub-pixels corresponding to the same switch unit to write the same fixed grayscale data voltage, the number of jumps of the data voltage signals may be reduced, and the power consumption may be reduced. In particular, because at least one first switch unit may always be turned on under the control of the corresponding clock signal line when at least two continuously scanned rows of sub-pixels are displaying, the continuously scanned rows of sub-pixels corresponding to the at least one switch unit which is always be turned on may be set to write the same fixed grayscale data voltage, and the power consumption may be further reduced with the cooperation of the time sequence signal and the data writing signal. In one embodiment, the fixed grayscale data voltage may be zero grayscale voltage. For example, when the driving transistor in the sub-pixel driving circuit is a P-type transistor, the fixed grayscale data voltage may be at a high level. The specific implementation may be based on actual design requirements, may not be limited in the present disclosure.

In one embodiment, the display device may include M rows of sub-pixels. In one frame of display picture, at least one switch unit may always be turned on under the control of the corresponding clock signal line when M1 rows of continuously scanned first-type of sub-pixels are displaying; and may be turned on under the control of the corresponding clock signal line with pre-determined order when M2 rows of continuously scanned second type of sub-pixels are displaying. M, M1 and M2 may be all integers, $M \geq M1+M2$, M1 and $M2 \geq 0$.

Figure 6:
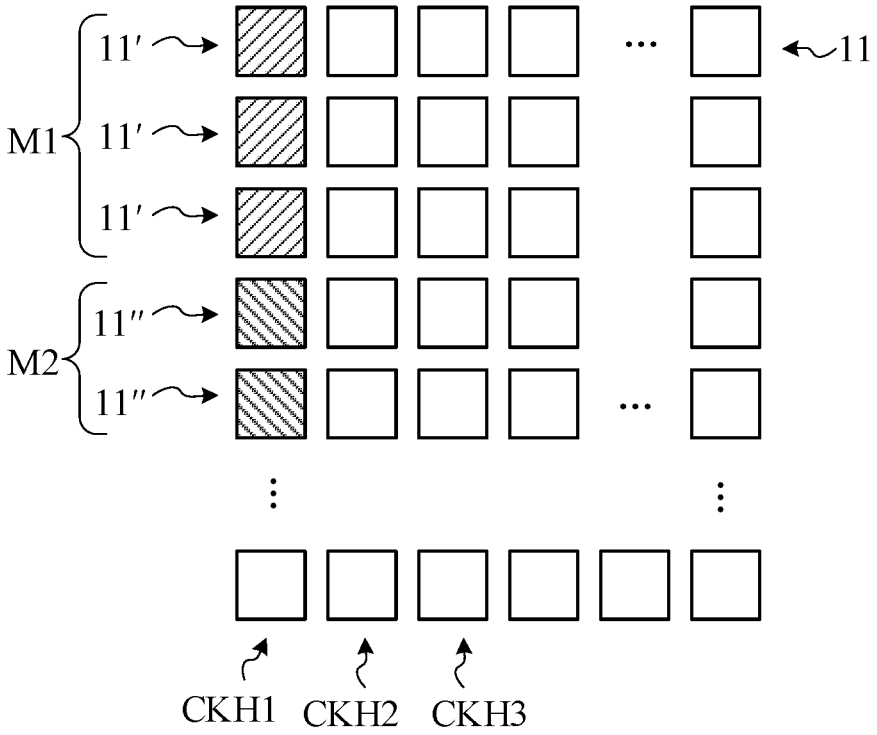
FIG. 6 illustrates an exemplary display device consistent with various disclosed embodiments of the present disclosure.
Figure 7:
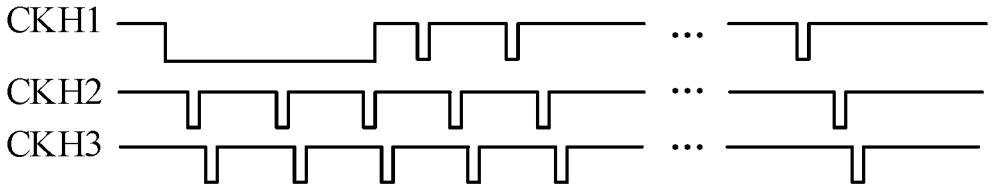
FIG. 7 illustrates a control time sequence of a portion of switches in FIG. 6.

FIG. 6 illustrates an exemplary display device consistent with various disclosed embodiments of the present disclosure. As shown in FIG. 6, the display device may include M rows of sub-pixels 11. The M rows of sub-pixels may include M1 rows of continuous first-type of sub-pixels 11' and M2 continuous rows of second type of sub-pixels 11'. In FIG. 6, for illustrative, M1=3 and M2=2, and the values of M1 and M2 are not limited in the present disclosure. In one frame of displayed image, FIG. 7 illustrates an exemplary control time sequence of some of the switch units in FIG. 6. Taking the switch units being as P-type transistors as an example, referring to FIG. 7, when the M1 rows of continuously scanned first type of sub-pixels are displaying, their control terminal voltages may all be at low level, and the switch units may always be on during the corresponding time period. When the M2 rows of continuously scanned second type of sub-pixels are displaying, the control terminal voltage may be at the low level when the data voltage signal is written, and in other time periods, the control terminal voltage may be at high level to turn on switch units sequentially in the preset order. Compared with existing method, the times of the jumps of the control voltage of the switch units may be reduced; and the power consumption of the display device may be reduced.

In one embodiment, the first-type of sub-pixels and the second-type of sub-pixels may be alternately arranged. M, M1, and M2 may all be integers, and $M \geq M1+M2$, $M1 \geq 2$, $M2 \geq 1$.

Figure 8:
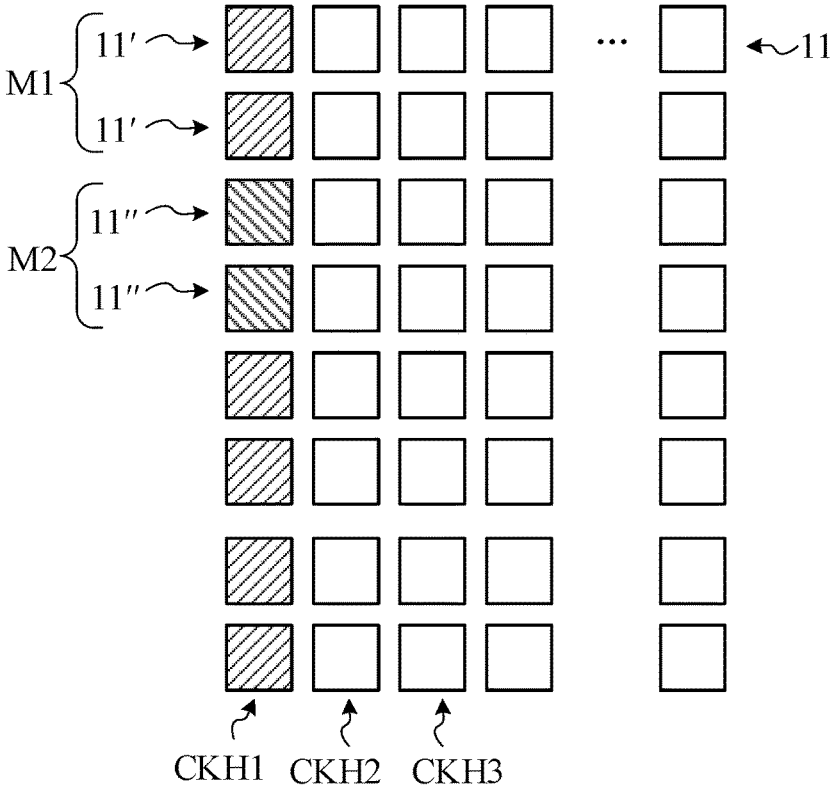
FIG. 8 illustrates another exemplary display device consistent with various disclosed embodiments of the present disclosure.

FIG. 8 illustrates another exemplary display device consistent with various disclosed embodiments of the present disclosure. As shown in FIG. 8, the display device may include M rows of sub-pixels 11. The M rows of sub-pixels 11 may include M1 rows of continuous first-type of sub-pixels and M2 rows of continuous second-type of row sub-pixels 11'. The first type of row pixels 11' and the second-type of row sub-pixels 11" may be alternately arranged. For illustrative purpose, in FIG. 8, M1=2, and M2=2. The values of M1 and M2 are not limited in the present disclosure.

Figure 9:
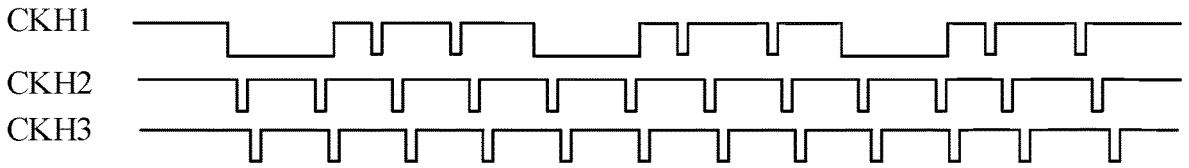
FIG. 9 illustrates a control time sequence of a portion of switches in FIG. 8.

FIG. 9 illustrates an exemplary control time sequence of some switch units in FIG. 8. As shown in FIG. 9, in one embodiment, at least one switch unit may always be turned on under the control of the corresponding clock signal line when all rows of sub-pixels are displaying. M=M1, M2=0, and $M1 \geq 2$.

Figure 10:
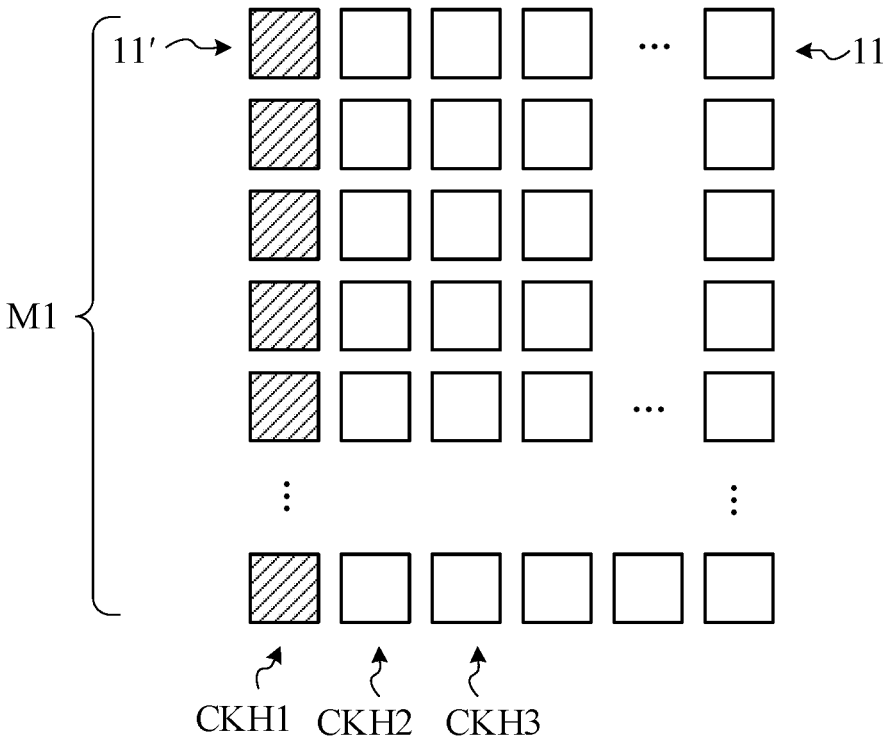
FIG. 10 illustrates another exemplary display device consistent with various disclosed embodiments of the present disclosure.

FIG. 10 illustrates another exemplary display device consistent with various embodiments of the present disclosure. As shown in FIG. 10, the display device may include M rows of sub-pixels 11, and all rows of sub-pixels 11 may be the first type of sub-pixels.

Figure 11:
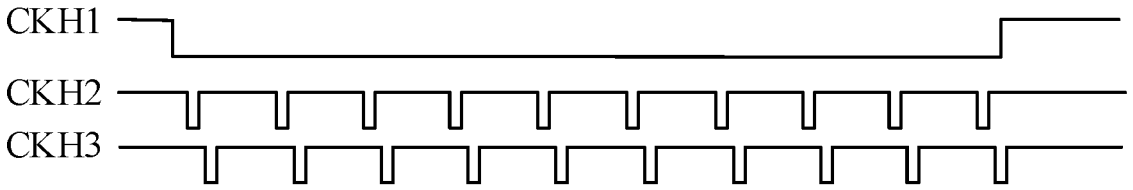
FIG. 11 illustrates a control time sequence of one portion of switches in FIG. 10.

FIG. 11 illustrates an exemplary control time sequence of some switch units in FIG. 10. As shown in FIG. 10, there may be at least one switch unit that may be always turned on during the process of displaying one frame of picture.

It should be noted that, in the previously described embodiments, the first type of row sub-pixels may refer to that the switch unit corresponding at least one sub-pixel of the row of sub-pixels may always be turned on when the at least one sub-pixel in the row of sub-pixels is displaying, and not all switch units corresponding to the row of sub-pixels are always turned on. In some embodiments, M1 and M2 may be set according to actual conditions. For example, when M is an even number, M1 and M2 may be respectively M/2, which can be flexibly selected according to actual conditions during the specific implementation.

In one embodiment, from the n-th frame of display image to the (n+i)-th frame of display image, the switch units that are always on when the M1 rows of continuously scanned sub-pixels may be sequentially turned on with a preset order from the (n+i+1)-th frame of display imaged to the (n+i+j+1)-th frame of display image when the M1 rows of continuously scanned sub-pixels. From the n-th frame of display image to the (n+i)-th frame of image, the switch units that are turned on sequentially with the present order may be always turned on when the M2 rows of continuous scanned sub-pixels are displayed are displaying. n, i, and j may be positive integers.

Among them, the sub-pixels corresponding to the always-on switch units may all be written with the same fixed grayscale data voltage, for example, 0 grayscale voltage. In particular, the display is in a black state. The sub-pixels corresponding to the switch units that are sequentially turned on in the preset order may be sequentially written with the data voltage for normal display.

Figure 12:
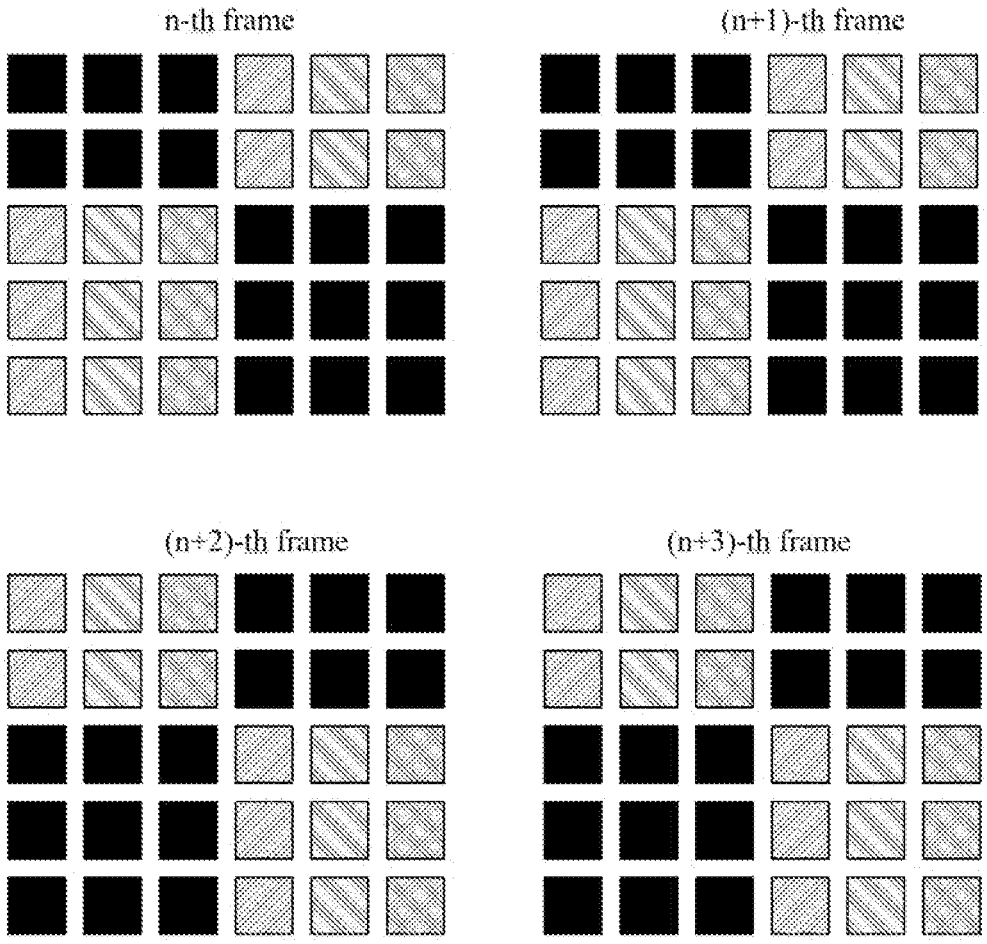
FIG. 12 illustrates the image display of an exemplary display device from an n-th frame to an (n+i+j+1)-th frame consistent with various disclosed embodiments of the present disclosure.

FIG. 12 illustrates an exemplary display device that displays from the n-th frame to the (n+i+j+1)-th frame consistent with various disclosed embodiments of the present disclosure. In FIG. 12, i=j=1. The value of i and j are not limited by the present disclosure. In the n-th frame and the (n+1)-th frame, the switch units corresponding to the first three sub-pixels in the M1 rows of the sub-pixels (M1=2 as an example in FIG. 12) may always be turned on and may display at a black state. The switch units corresponding to such sub-pixels may be sequentially turned on with the present order at the (n+2)-th frame and (n+3)-th frames, and the sub-pixels may display as a normal grayscale (the different filling methods may be sub-pixels of different light emission colors). In the n-th frame and the (n+1)-th frame, the switch units corresponding to the first three sub-pixels of the last M2 (M2=3 in FIG. 12) rows of sub-pixels may be sequentially turned on with the preset order and may display as a normal grayscale. The switch units corresponding to these sub-pixels may always be turned on at the (n+2)-th frame and the (n+3)-th frame and may display as the black state. Such a display mode may reduce the number of voltage jumps of the time sequence of the control switch units, and the power consumption of the display device may be reduced.

In some embodiments, i and j may be other positive integers, and the values of i and j may be the same or different; and may not be limited in the present disclosure.

In another embodiment, the switch units that are always on when the continuously scanned M1 rows of sub-pixels are displaying at the k-th frame may be sequentially turned on with a preset order at the (k+1)-th frame. The switch units that are sequentially turned on with a preset order when the sub-pixels of the continuously scanned M2 rows of sub-pixels at the k-th frame may be turned on at the (k+1)-th frame. k is a positive integer.

Figure 13:
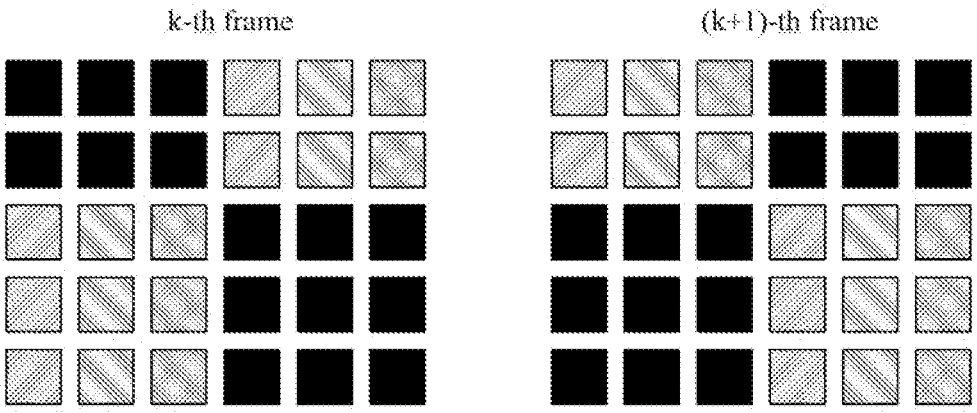
FIG. 13 illustrates the image display of an exemplary display device from a k-th frame to a (k+1)-th frame consistent with various disclosed embodiments of the present disclosure.

FIG. 13 illustrate the display of an exemplary display device from the k-th frame to the (k+1)-th frame consistent with various disclosed embodiments of the present disclosure. At the k-th frame, the switch units corresponding to the first three sub-pixels of the M1 (M1=2 in FIG. 13 as an example) rows of switch units may always be turned on and the sub-pixels may display at a black state. The switch units corresponding of these sub-pixels may be sequentially turned on with a preset order at the (k+1)-th frame, and the sub-pixels may display with a normal grayscale (different filling methods can be sub-pixels of different light-emitting colors). In the k-th frame, the switch units corresponding to the first three sub-pixels in the last M2 rows of sub-pixels (M2=3 is taken as an example in FIG. 13) may be sequentially turned on with a preset order, and the sub-pixels may display as the normal grayscale. The corresponding switch units of these sub-pixels may always be turned on at the (k+1)-frame, and the sub-pixels may display at a black state. By setting the display modes of the sub-pixels of adjacent frames to be in a complementary manner, the power consumption may be reduced. Under the premise of improving the uniformity of the display, the display effect may be improved.

In one embodiment, the display device may include M rows of sub-pixels, and in one frame of display picture, at least one switch unit may always be turned on under the control of the corresponding clock signal line when all rows of sub-pixels are displaying.

It can be understood that, in one embodiment, by setting at least one switch unit to be always on in one frame of display image, comparing with the existing driving method, the time sequence signals of a column of sub-pixels corresponding to the always-on switch units may all not jump. Thus, the power consumption may be effectively reduced.

Figure 14:
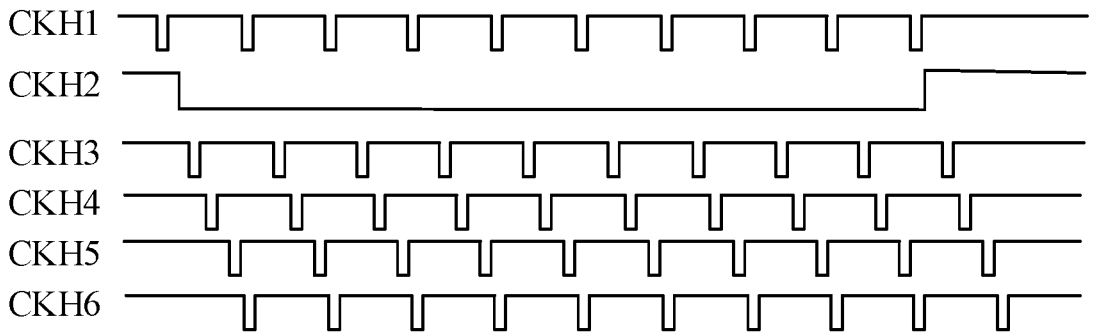
FIG. 14 illustrates a time sequence of a driving method of another exemplary display panel when displaying a frame consistent with various disclosed embodiments of the present disclosure.

FIG. 14 illustrates a time sequence diagram for another exemplary display device to display one frame of image. As shown in FIG. 14, for illustrative purposes, each row of sub-pixels may only have one multiplexer. The multiplexer may include 6 switch units. The switch units may be all P-type transistors. Further, FIG. 14 may illustrate only the control time sequence diagram of the switch units. The second switch units may always be on under the control of the corresponding clock signal lines. In particular, the time sequence signals of the second switch units may always be at the low level. Thus, comparing with the existing driving method, the number of voltage jumps of the time sequence signals may be reduced, the effect of reducing the power consumption of the display device may be achieved.

In one embodiment, in one frame of display image, the clock signals corresponding to multiple multiplexers may be same when each row of sub-pixels are displaying.

It can be understood that a display device may generally include multiple columns of sub-pixels, and one multiplexer generally may not be able to cover all columns of sub-pixels. Thus, the display device may need to be provided with multiple multiplexers.

Figure 15:
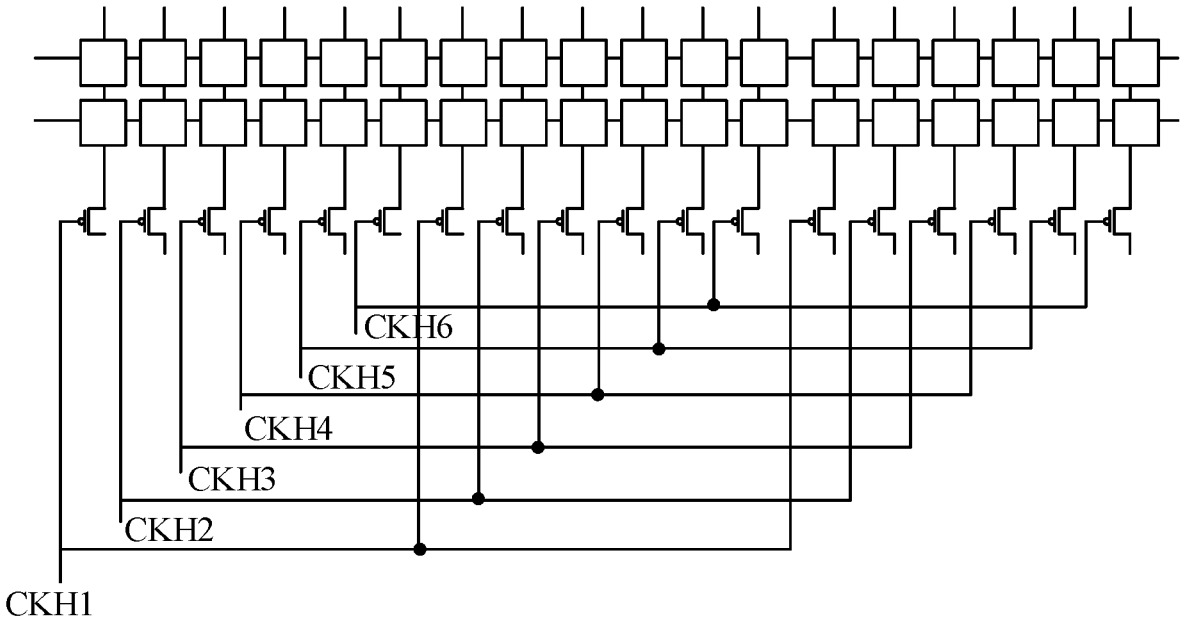
FIG. 15 illustrates another exemplary display device consistent with various disclosed embodiments of the present disclosure.

FIG. 15 illustrates another exemplary display device consistent with various disclosed embodiments of the present disclosure. As shown in FIG. 15, the control terminals of the switch units at the corresponding positions of each multiplexer may be connected together. In particular, three multiplexers are schematically shown in FIG. 15, each multiplexer may include six switch units, the first switch unit of each multiplexer may all be connected to the first time sequence signal line CKH1, and the second switch unit may all be connected to the second time sequence signal line CKH2, and so on, and the sixth switch unit may be connected to the sixth time sequence signal line CKH6. Thus, the clock signals corresponding to multiple multiplexers may be the same when a row of sub-pixels are displaying, and the circuit structure may be simplified. It can be understood that, for simplicity, FIG. 15 does not show the connection of each switch unit to the same data voltage input terminal.

In one embodiment, in one frame of display image, the data lines corresponding to the sub-pixels in the same row of sub-pixels may be written with the same data voltage signal in two adjacent data writing phases. In particular, the two adjacent data writing phases may be understood as two adjacent sub-pixels located in the same row may be sequentially written with the same data voltage signal, or two sub-pixels located in the same row but arranged at intervals may be sequentially written with the same data voltage signal. Thus, the same data voltage signal may be ensured to be written in the adjacent data writing phases; and the number of data voltage jumps may be reduced, and the power consumption may be reduced.

By writing the same data voltage signal to the data lines corresponding to the sub-pixels in the same row of sub-pixels in at least two adjacent data writing phases, the number of the data voltage signal jumps may be reduced, and the power consumption may be further reduced.

In some embodiments, the multiplexer may include two switch units, six switch units or twelve switch units, etc.

Among different display devices, smart watches, smart bracelets and other wearable devices may often use 1:6 or 1:12 multiplexers. 1:2 multiplexers may be used in mobile phones. In the specific implementation, the number of switch units in a multiplexer may be selected according to the actual situation; and is not limited in the present disclosure.

In one embodiment, the multiplexer may include twelve switch units counting from a first switch unit to a twelfth switch unit, and the first stage may include twelve data writing moment counting from a first data writing moment to a twelfth data writing moment. In the first stage of the data writing phase, the fourth switch unit to the sixth switch unit and the tenth switch unit to the twelfth switch unit may always be turned on under the control of the corresponding clock signal line. The first switch unit to the third switch unit and the seventh switch unit to the ninth switch unit, respectively, under the control of the corresponding clock signal line, may be turned on for a preset time from the first data writing moment to the third data writing moment, and the seventh data writing moment to the ninth data writing moment. At the same time, the data voltage input terminals may respectively write the data voltage signals to the data line corresponding to the first switch unit to the third switch unit and the seventh switch unit to the ninth switch unit at the first data writing moment to the third data writing moment, and the seventh data writing moment to the ninth data writing moment.

Figure 16:
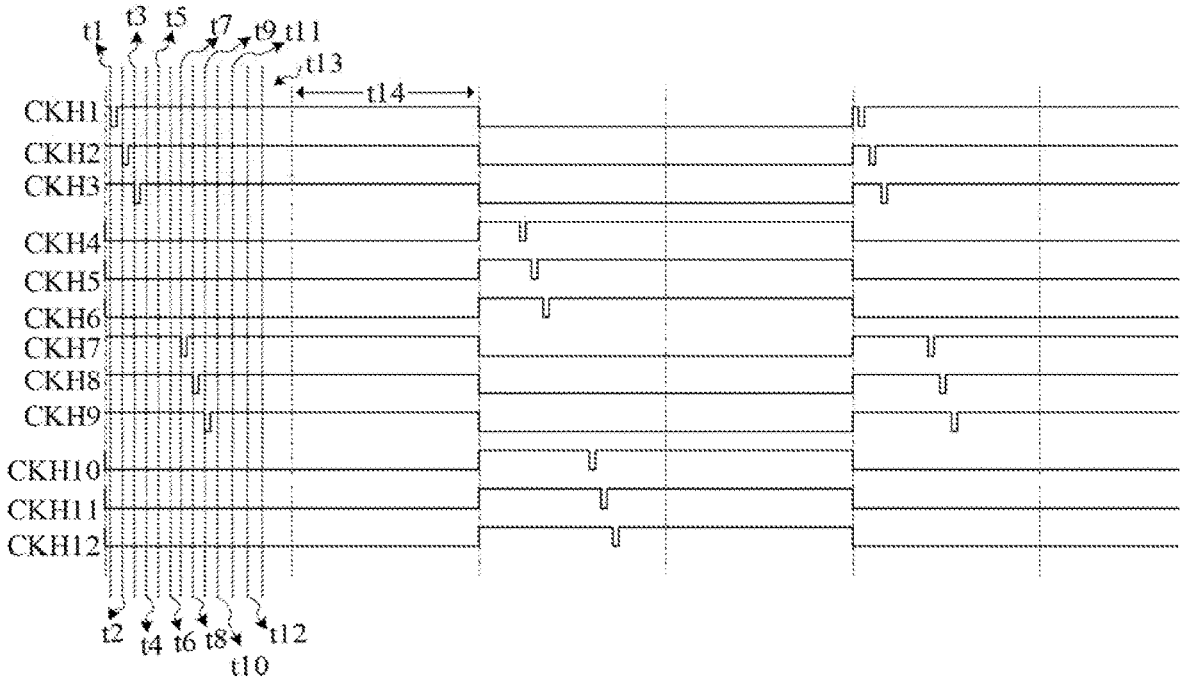
FIG. 16 illustrates a time sequence of an exemplary driving method of a display device consistent with various disclosed embodiments of the present disclosure.

FIG. 16 illustrates a time sequence diagram of an exemplary driving method of a display device according to various disclosed embodiments of the present disclosure. As shown in FIG. 16, the first switch unit to the twelfth switch unit may be respectively controlled by the time sequence signals CKH1-CKH12. The first stage of the data writing phase may include the first data writing moment t1 to the twelfth data writing moment t12. In the first stage of the date wiring phase, CKH4-CKH6 and CKH10-CKH12 may respectively control the fourth switch unit to the sixth switch unit, and the tenth switch unit to the twelfth switch unit to keep them being always on; and CKH1-CKH3 and CKH7-CKH9 may respectively control the first switch unit to the third switch unit and the seventh switch unit to the ninth switch unit to keep them to be being on for a preset time at the first data writing moment t1 to the third data writing moment t3 and the seventh data writing moment t7 to the ninth data writing moment t9. At the same time, the data voltage input terminals may respectively write the data voltage signals to the data lines corresponding to the first switch unit to the third switch unit and the seventh switch unit to the ninth switch unit at the first data writing moment t1 to the third data writing moment t3, and the seventh data writing moment t7 to the ninth data writing moment t9. Then, the time sequence signal of the next frame may be opposite to the time sequence signal of the previous frame such that different frames may be displayed and all sub-pixels may display alternately. Accordingly, the uniformity of the display screen may be improved. Because the fourth switch unit to the sixth switch unit, and the tenth switch unit to the twelfth switch unit may always be on, and the data voltage signals written to other columns may be written each time, it is necessary to set a maintaining time period t13 after the twelfth data writing moment t12. In the maintaining time period, a fixed data voltage signal, such as a zero grayscale voltage signal, may be written to the switch units that are always turned on. The time period t14 stage may be the Frame Skip stage.

In the above embodiment, there are three data writing moments between the "on" period of the seventh switch unit and the "on" period of the third switch unit. Because the sub-pixels corresponding to the always-on switch units may be written with a same data voltage signal, the seventh switch unit may be turned on earlier to reduce the jump of the data voltage signal. In one embodiment, the multiplexer may include twelve switch units counting from a first switch unit to a twelfth switch unit, and the first stage of the data writing phase may include twelve data writing moment counting from the first data writing moment to the twelfth data writing moment. In the first stage of the data writing phase, the fourth switch unit to the sixth switch unit and the tenth switch unit to the twelfth switch unit may always be turned on under the control of the corresponding clock signal lines, the first switch unit to the third switch unit and the seventh switch unit to the ninth switch unit may be respectively turned on for the preset time under the control of the corresponding clock signal lines at the first data writing moment to the third data writing moment and the fourth data writing moment to the sixth data writing moment. At the same time, the data voltage input terminals may respectively write the data voltage signals to the data lines corresponding the first switch unit to the third switch unit and the seventh switch unit to the ninth switch unit at the first data writing moment to the third data writing moment and the fourth data writing moment to the sixth data writing moment.

Figure 17:
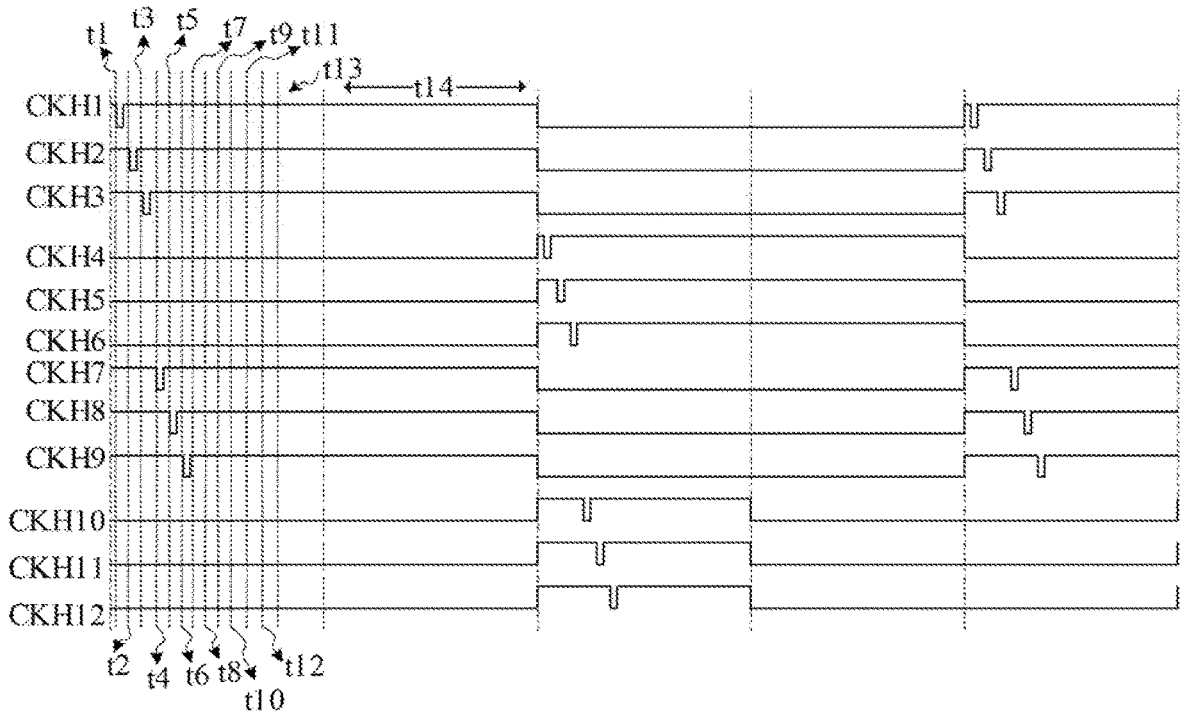
FIG. 17 illustrates a time sequence of another exemplary driving method of a display device consistent with various disclosed embodiments of the present disclosure.

FIG. 17 illustrates a time sequence diagram of another exemplary driving method of a display device according to various disclosed embodiments of the present disclosure. The major difference from FIG. 16 may that the turn-on time of the seventh switch unit to the ninth switch unit may be shifted to the fourth data writing moment t4 to the sixth data writing moment t6. By doing so, the time after the seventh data writing time may be multiplexed as the maintaining phase. Thus, the time of the data voltage signal jumps may be reduced.

In one embodiment, in the display maintaining phase, the status of each switch unit of the multiplexer may be same as the status of the second stage of the data writing phase, or all switch units of the multiplexer may be turned on.

It is understandable that in the display maintaining phase, no data voltage signal may be written, and the screen displayed before may be maintained at this time. Thus, the state of each switch unit may not affect the display effect at this time. In one embodiment, the status of each switch unit of the multiplexer may be the same as the status in the second stage of the data writing phase. The on/off status of the switch unit may be changed after the beginning of the next frame, or it may all be turned on at this stage, and the action may be performed when the next frame is displayed. The status of the switch unit in the display maintaining phase is not limited by the present disclosure.

The present disclosure also includes providing a display device. The display device may include a display panel and a driving chip. The display panel may include a plurality of sub-pixels arranged as an array. Each row of sub-pixels may be connected by a scan line, and each column of sub-pixels may be connected by a data line. The display panel may also include a plurality of multiplexers. Each multiplexer may include at least two switch units. The output terminals of different switch units of the same multiplexer may be connected to different data lines. The input terminals of the switch units in each multiplexer may be connected to a same data voltage input terminals. The control terminals of different switch units of the same multiplexer may be connected to different clock control signal lines. The driving chip may be used to implement any driving method provided by the present disclosure.

The display device provided by the present disclosure may be wearable devices such as watches and smart bracelets, and may also be applied to other scenarios that require low power consumption. The display device may execute any of the driving methods provided in the present disclosure, and may have the advantages of the low power consumption.

It should be noted that the above are only the preferred embodiments of the present disclosure and the applied technical principles. Those skilled in the art will understand that the present disclosure is not limited to the specific embodiments described herein, and various obvious changes, readjustments, mutual combinations and substitutions can be made to those skilled in the art without departing from the protection scope of the present disclosure. Therefore, although the present disclosure has been described in more detail through the above embodiments, the present disclosure is not limited to the above embodiments, and can also include more other equivalent embodiments without departing from the concept of the present disclosure. The scope of is determined by the scope of the appended claims.

What is claimed is:

1. A method for driving a display device, comprising:

providing the display device, wherein the display device includes a plurality of sub-pixels arranged as an array; each row of the plurality of sub-pixels are connected by a scan line; each column of the plurality of sub-pixels are connected by a data line; the display device also includes a plurality of multiplexers; each multiplexer of the plurality of multiplexers includes m switch units; the m switch units include m1 first switch units and m2 second switch units; m, m1, and m2 are all positive integers, and m≥m1+m2; output terminals of different switch units of a same multiplexer are connected to different data lines; input terminals of all switch units of the same multiplexer are connected to a same data voltage input terminal; control terminals of different switch units of the same multiplexer are connected to different clock signal lines; and a row display time period of a row of sub-pixels of one frame of display image of the display device includes a data writing phase and a display maintaining phase;

in a first stage of the data writing phase, always turning on the m1 first switch units of each multiplexer under a control of corresponding m1 clock signal lines, and sequentially turning on the m2 second switch units for a preset time in a preset order under a control of corresponding m2 clock signal lines;

in a second stage of the data writing phase, keeping the m1 first switch units being turned on under the control of the corresponding m1 clock signal lines, turning off the m2 second switch units under the control of the corresponding m2 clock signal lines, and writing corresponding data voltage signals to the row of sub-pixels to cause the row of sub-pixels to display under a control of corresponding scan lines; and in the display maintaining phase, displaying same as in the second stage of the data writing phase, wherein at least one of the plurality of first switch units is always turned on under a control of a corresponding clock signal line when at least two continuously scanned rows of sub-pixels are displaying.

2. The method according to claim 1, further comprising:

writing a same fixed grayscale data voltage to sub-pixels of at least two continuously scanned rows of sub-pixels corresponding to a same switch unit.

3. The method according to claim 2, wherein:

the fixed grayscale data voltage is 0 grayscale voltage.

4. The method according to claim 1, wherein:

the display device includes M rows of sub-pixels;

in one frame of display image, at least one of the plurality of switch units is always turned on under a control of a corresponding clock signal line when M1 rows of continuously scanned first type of sub-pixels are displaying and is sequentially turned on in a preset order under a control of a corresponding signal line when M2 rows of continuously scanned second type of sub-pixels are displaying; and M, M1 and M2 are integers, and M≥M1+M2, M1≥2 and M2≥0.

5. The method according to claim 4, wherein:

the first type of sub-pixels and the second type of sub-pixels are alternatively arranged; and M, M1 and M2 are integers, and M>M1+M2, M1≥2 and M2≥0.

6. The method according to claim 4, wherein:

at least one of the plurality of switch units is always turned on under a control of a corresponding clock signal line when all rows of sub-pixels are displaying; and M=M1, M2=0 and M1≥2.

7. The method according to claim 4, wherein:

from an n-th frame of display image to an (n+i)-th frame of display image, switch units, that are always turned on when the M1 rows of continuously scanned sub-pixels are displaying, are sequentially turned on in a preset order from an (n+i+1)-th frame of display image to an (n+i+j+1)-th frame of display image when the M1 rows of continuously scanned sub-pixels are displaying;

from the n-th frame of display image to the (n+i)-th frame of display image, switch units, that are sequentially turned on in a present order when the M2 rows of continuously scanned sub-pixels are displaying, are always turned on from an (n+i+1)-th frame of display image to an (n+i+j+1)-th frame of display image when the M2 rows of continuously scanned sub-pixels are displaying; and n, i and j are positive integers.

8. The method according to claim 4, wherein:

switch units, that are always turned on in a k-th frame of display image when the M1 rows of continuously scanned sub-pixels are displaying are sequentially turned on in a preset order in a (k+1)-th frame of display image;

switch units, that are turned on for the preset time in the present order in the k-th frame of display image when the M2 rows of continuously scanned sub-pixels are displaying, are always turned on in the (k+1)-th frame of display image; and k is a positive integer.

9. The method according to claim 1, wherein:

the display device includes M rows of sub-pixels; and in one frame of display image, at last one switch unit is always turned on under a control of a corresponding clock signal when all rows of sub-pixels are displaying.

10. The method according to claim 1, wherein:

in one frame of display image, clock signals corresponding to multiple multiplexers of the plurality of multiplexers are same when each row of sub-pixels are displaying.

11. The method according to claim 1, wherein:

in one frame of display images, signal lines corresponding to a same row of sub-pixels are written with a same data voltage signal in at least two adjacent data writing stages.

12. The method according to claim 1, wherein:

each multiplexer of the plurality of multiplexers includes two switch units, six switch units, or twelve switch units.

13. The method according to claim 12, wherein:

the multiplexer includes twelve switch units counting from a first switch unit to a twelfth switch unit and the first stage of the data writing phase includes twelve data writing moment counting from a first data writing moment to a twelfth data writing moment; and in the first stage of the data writing phase, a fourth switch unit to a sixth switch unit in the twelve switch units and a tenth switch unit to the twelfth switch unit in the twelve switch units are always turned on under a control of corresponding clock signal lines, the first switch unit to the third switch unit and the seventh switch to the ninth switch unit in the twelve switch units are turned on for a preset time under a control of corresponding clock signal lines at the first data writing moment to the third data writing moments and the seventh data writing moment to the ninth data writing moment and, at the same time, the data voltage terminals respectively write data voltage signals to data lines corresponding to the first switch unit to the third switch unit and the seventh switch unit to the ninth switch unit at the first data writing moment to the third data writing moment and the seventh data writing moment to the ninth data writing moment.

14. The method according to claim 12, wherein:

the multiplexer includes twelve switch units counting from a first switch unit to a twelfth switch unit and the first stage of the data writing phase includes twelve data writing moment counting from a first data writing time to a twelfth switch unit; and in the first stage of the data writing phase, a fourth switch unit to a sixth switch unit in the twelve switch units and a tenth switch unit to a twelfth switch unit in the twelve switch units are always turned on under a control of corresponding clock signal lines, a first switch unit to a third switch unit in the twelve switch units and the seventh switch to the ninth switch unit in the twelve switch units are turned on for a preset time under a control of corresponding clock signal lines at the first data writing moment to a third data writing moment in the twelve data writing moments and a fourth data writing moment to the sixth data writing moment in the twelve data writing moments and, at the same time, the data voltage terminals respectively write data voltage signals to data lines corresponding the first switch unit to the third switch unit and the seventh switch unit to the ninth switch unit at the first data writing time to the third data writing time and the fourth data writing time to the sixth data writing time.

15. The method according to claim 1, wherein:

in the display maintaining phase, status of all switch units of the plurality of multiplexers is same as status of all switch units of the plurality of multiplexers in the second stage of the data writing phase; or all switch units of the plurality of multiplexers are turned on.

16. A display device, comprising:

a display panel; and a driving chip, wherein:

the display panel includes a plurality of sub-pixels arranged as an array; each row of sub-pixels are connected by a scan line; each column of sub-pixels are connected by a data line; the display panel also includes a plurality of multiplexers; each multiplexer includes at least two switch units; output terminals of different switch units of a same multiplexer are connected to different data lines; input terminals of all switch units of the same multiplexer are connected to a same data voltage input terminal; control terminals of different switch units of the same multiplexer are connected to different clock signal lines; and the driving chip is used to execute the driving method according to claim 1.

* * * * *